US008789622B1

(12) United States Patent
Farrar et al.

(10) Patent No.: US 8,789,622 B1
(45) Date of Patent: Jul. 29, 2014

(54) CONTINUOUS MICROWAVE PARTICULATE TREATMENT SYSTEM

(71) Applicant: KMC Oil Tools B.V., Amsterdam (NL)

(72) Inventors: Joseph Daniel Farrar, Houston, TX (US); Perry Don Lyman, Houston, TX (US)

(73) Assignee: KMC Oil Tools B.V., Amsterdam (NL)

( * ) Notice: Subject to any disclaimer, the term of this patent is extended or adjusted under 35 U.S.C. 154(b) by 0 days.

(21) Appl. No.: 14/262,427

(22) Filed: Apr. 25, 2014

Related U.S. Application Data

(63) Continuation-in-part of application No. 13/498,481, filed as application No. PCT/US2010/050315 on Sep. 25, 2010.

(60) Provisional application No. 61/246,494, filed on Sep. 28, 2009.

(51) Int. Cl.
*E21B 21/06* (2006.01)

(52) U.S. Cl.
CPC ..... *E21B 21/066* (2013.01)
USPC ..... 175/66; 175/17; 175/206

(58) Field of Classification Search
CPC ..... E21B 21/063
USPC ..... 175/17, 66, 206
See application file for complete search history.

(56) References Cited

U.S. PATENT DOCUMENTS 4,636,308 A * 1/1987 Summers ..... 210/195.1
5,055,180 A * 10/1991 Klaila ..... 208/402
5,944,418 A 8/1999 Orr et al.
6,244,362 B1 6/2001 Williams
6,508,583 B1 1/2003 Shankwitz et al.
6,530,438 B1 3/2003 McIntyre
6,585,115 B1 7/2003 Reddoch et al.
8,561,718 B2 * 10/2013 Calleri ..... 175/17
8,656,991 B2 2/2014 Farrar et al.
8,662,163 B2 3/2014 Farrar et al.
2003/0217866 A1 11/2003 deBoer
2004/0129611 A1 7/2004 Whitsel et al.
2005/0153844 A1 7/2005 McIntyre
2005/0242003 A1 11/2005 Scott et al.
2006/0086676 A1 4/2006 Smith
2006/0102390 A1 5/2006 Burnett et al.
2006/0185236 A1 8/2006 Hill
2007/0131592 A1 6/2007 Browne et al.
2007/0183853 A1 8/2007 Eide
2010/0200300 A1 * 8/2010 Robinson et al. ..... 175/66
2012/0088950 A1 * 4/2012 Dodds et al. ..... 588/310
2012/0181086 A1 7/2012 Addison et al.

* cited by examiner

*Primary Examiner* — Giovanna Wright
*Assistant Examiner* — Richard Alker
(74) *Attorney, Agent, or Firm* — Buskop Law Group, PC; Wendy Buskop

(57) ABSTRACT

A continuous microwave particulate treatment system for treating fluid from a wellbore. The system uses a material handling controller, a vibrating sieve device or filtering device to separate particulate from drilling fluid, a cuttings discharge collection device for continuously moving the slurry to a cuttings processing station, a treatment system controller controlling the continuous cuttings processing station that uses a microwave generator creating microwaves that heat the slurry and a plurality of non-deforming microwave heatable polishing and grinding media in a vibrating trough. The system continuously creates water vapor with oil droplets and cleaned cuttings, and a vapor recovery system is used for removing the oil droplets from the water vapor having a vapor recovery system controller in communication with the material handling and treatment system controllers.

18 Claims, 7 Drawing Sheets

CONTINUOUS MICROWAVE PARTICULATE TREATMENT SYSTEM

CROSS REFERENCE TO RELATED APPLICATIONS

The current application is a continuation in part and claims priority to co-pending U.S. patent application Ser. No. 13/498,481 filed on Mar. 27, 2012, entitled "DRILL CUTTINGS METHODS AND SYSTEMS," which is a 371 filing of PCT/US2010/050315 filed on Sep. 25, 2010, which claims priority to and the benefit of U.S. Provisional Patent Application Ser. No. 61/246,494 filed on Sep. 28, 2009. These references are hereby incorporated in their entirety.

FIELD

The present embodiments generally relate to a continuous microwave particulate treatment system for treating drill cuttings, particulate and fluid coming from a wellbore.

BACKGROUND

A need exists for continuous microwave particulate treatment system for treating drill cuttings that can separate and recover of hydrocarbons from particulate matter which can be used offshore.

A further need exists for a continuous microwave particulate treatment system for treating drill cuttings that reduces risk in treating drilling fluid on land and offshore.

As described above, current systems for the removal of oil from drill cuttings require large quantities of energy. New continuous microwave particulate treatment systems for treating drill cuttings are needed that efficiently use energy to continuously remove decontaminants from the drill cuttings.

The present embodiments meet these needs.

BRIEF DESCRIPTION OF THE DRAWINGS

The detailed description will be better understood in conjunction with the accompanying drawings as follows:

FIG. 5A depicts a drilling rig with the continuous microwave particulate drilling system on a floating vessel.

Figure 1:
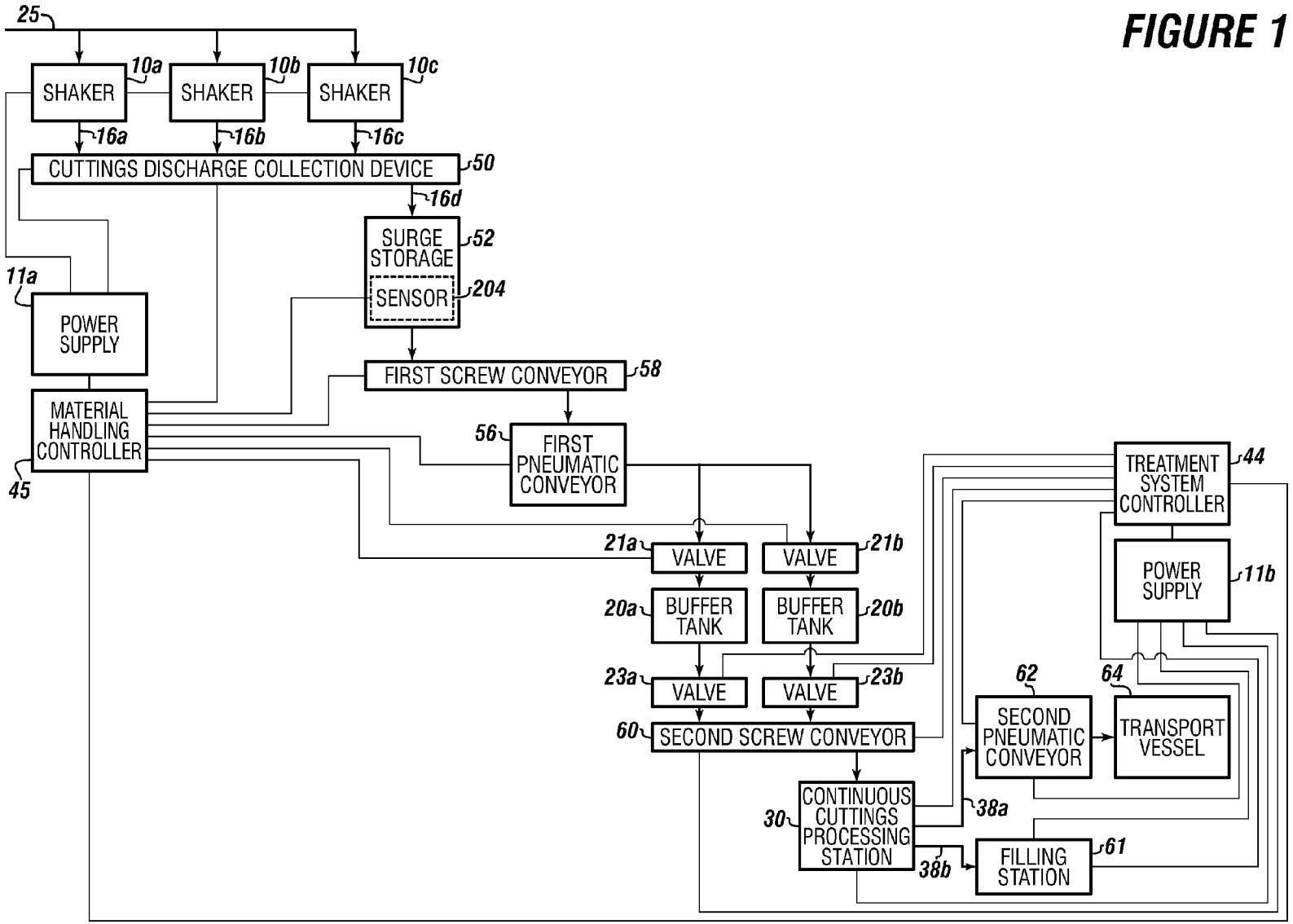
FIG. 1 depicts a diagram of a portion of the particulate treatment system.

Present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The embodiments relate to a continuous microwave particulate treatment system for treating drilling waste from a wellbore using a materials handling controller.

The continuous microwave particulate treatment system for treating drill cuttings continuously operates a means for separating particulate from drilling fluid to separate a slurry from drilling fluid from a wellbore.

The system can include a cuttings discharge collection device for continuously moving the slurry to a cuttings processing station from the means for separating particulate from drilling fluid.

A treatment system controller can control the cuttings processing station that uses a microwave generator for creating microwaves that heat the slurry and heat a plurality of non-deforming microwave heatable polishing and grinding media in a vibrating trough.

The two controllers and the apparatus are used to continuously create (i) a water vapor with oil droplets and (ii) cleaned cuttings from the slurry.

In embodiments, the system can include a connected vapor recovery system for removing the oil droplets from the water vapor.

The vapor recovery system can have a vapor recovery system controller in communication with the material handling controller and treatment system controller to manage transport, preventing overflow, and ensuring continuous discharge of particulate.

The following definitions are used herein.

The term "buffer tank" can refer to a metal or other vessel which can hold slurries, such as 50 to 250 barrels of slurry.

The term "cuttings discharge collection device" can be a screw conveyor or an auger for continuously moving cuttings discharge from the means for separating particulate from drilling fluids on the drilling rig away from the means for separating particulate from drilling fluids.

The term "fluid" as used herein can include drill cuttings in particulate form, in a slurry or in a mud, and can include other particulates, such as barite, bentonite and other particulates.

The term "G force" refers to gravity force on the particulates in the vibrating trough.

The term "non-deforming microwave heatable polishing and grinding media" refers to a variety of microwave absorbing materials, such as ceramic balls with diameters from 1 inch to 6 inches. In embodiments, the non-deforming microwave heatable polishing and grinding media are selected for the rate of absorbing and rate of emitting the microwave energy as heat. In embodiments the non-deforming microwave heatable polishing and grinding media can have different shapes. In embodiments, the non-deforming microwave heatable polishing and grinding media can have different diameters, lengths and widths.

The term "particulate" as used herein can refer to waste, including drilling cuttings from drilling fluid or fluid produced from working over a wellbore.

The term "pneumatic conveyor" refers to a controllable pressurized vessel that is pressurized from a compressed air supply. In embodiments, the pneumatic conveyor can accept pressurized air in a low pressure range from 20 psi to 200 psi.

The term "power supply" can refer to a rig power supply, a utility supplied power connection, or freestanding generators connected to a fuel supply.

The term "screw conveyor" refers to a variety of rotating Archimedes screws or screw pumps for transporting material including slurries. In an embodiment, a screw conveyor can be an auger. The screw conveyors can vary in length and speed of rotation.

The term "means for separating particulate from drilling fluid" refers to vibrating sieve devices such as shakers or other filtering devices to remove a user defined size of solids from slurry, such as devices that use screens classified by the American Petroleum Institute (API) RP13C. An exemplary means for separating particulate from drilling fluid can remove particles with diameters from 0.1 inch and 0.3 inches.

A feature of the invention is that no additional liquid other than water needs be mixed with the drill cuttings or fluid from the work over. More specifically, no ionic liquids need be mixed with or otherwise placed in contact with particulate matter prior to removing at least one hydrocarbon from the particulate using this system. The current system is much more environmentally friendly than currently available systems. The current process minimizes the need for additional toxic material while separating the oil from the particulate.

The invention is usable for treating drilling fluid containing drill cuttings, crude oil containing sand, beach sand contaminated with oil, oil sludge, any hydrocarbon containing sand, soil, rock, silt, clay or other solid particulate or any hydrocarbon contained within sand, soil, rock, silt, clay or other solid particulate, such as Barite.

The system can involve simultaneously heating water from the drilling fluid or workover fluid, which does not contain added ionic liquids, to separate oil and water from particulate matter at relatively low temperatures as low as 100 degrees Celsius, while simultaneously vibrating the particulate to ensure thorough cleaning, that is, thorough removal of the oil from the particulate.

Optionally, the separation temperature can be raised to lower the viscosity of the hydrocarbon being separated and aid in separation of hydrocarbon from particulate material and create a vapor with oil particles suspended in the vapor.

In the invention, the separation temperature can be raised by microwave heating of the particulate and non-deforming microwave heatable polishing and grinding media surrounding the particulate, while simultaneously vibrating the particles, all done offshore, without the need to transport the drill cuttings to another location.

While using little energy, the invention produces cleaned material.

The invention creates a small carbon footprint enabling the device to be desirable on rigs needing compliance with Environmental Protection Agency requirements.

The invention uniquely requires no additional solvent such as toluene to be added or mixed to the drilling cuttings or drilling mud in order to clean the particulate. Only the water in the drilling fluid is targeted by the microwave generators for preferential heating of the water while also heating the isotropic radiator in the trough.

The invention has the simultaneous feature of heating while vibrating, capturing the oil in the vapor and then have a vapor recovery system which can all be handled directly on a rig.

There is no need to use any organic solvent to dissolve non-polar hydrocarbons such as bitumen, oil or drilling fluid. There is no need to add any type of organic solvent can include toluene, naphtha, hexane, kerosene, paraffinic solvents or any other non-polar hydrocarbon solvent that dissolves the hydrocarbon. There is simply no need to dissolve the hydrocarbon in another substance other than water creating an improved separation process.

The invention is a continuous microwave particulate treatment system for fluid from a wellbore.

The invention can use three different controllers simultaneously to control and operate the equipment recover oil from fluids from a wellbore, and produce cleaned particulate.

In embodiments, a single master controller can operate the entire system.

One controller can be a treatment systems controller to continuously operate a means for separating particulate from drilling fluid for separating slurry from the fluid as well as operate a cuttings discharge collection device for continuously moving the slurry to a cuttings processing station.

The treatment systems controller can also operate the cuttings processing station that simultaneously vibrates and heats particulate from the fluid from the wellbore.

The second controller can be a material handling controller that communicates to a cuttings discharge collection device, a surge storage, a first pneumatic conveyor and a screw conveyor all simultaneously for transporting the treated material to discharge.

The cuttings processing station can have a vibrating trough, a plurality of non-deforming microwave heatable polishing and grinding media disposed in the vibrating trough, at least one microwave generator for creating microwaves that heat the slurry and the non-deforming microwave heatable polishing and grinding media in the vibrating trough, and a microwave waveguide for each microwave generator targeting microwaves into the vibrating trough to continuously create (i) a water vapor with oil droplets and (ii) cleaned cuttings.

The invention can include a vapor recovery system which can have a vapor recovery system controller.

The three controllers can communicate with each other allowing for continuous drilling fluid or work over fluid treatment, continuous vapor treatment and continuous disposition of the cleaned particulate.

Turning now to the Figures, FIG. 1 depicts a diagram of a portion of the particulate treatment system and materials handling equipment to separate oil from particulate such as drill cuttings from drilling fluid, or oil from work over fluid.

The depicted portion of the particulate treatment system can continuously treat the drill cuttings and fluid containing particulate as the drilling fluid comes from the well.

The particulate treatment system can treat particulate from 2 microns to 1000 microns in diameter.

The particulate treatment system can include a plurality of means for separating particulate from drilling fluid 10*a*, 10*b*, and 10*c*, which can be shakers, as shown in this embodiment.

Each means for separating particulate from drilling fluid can continuously receive fluid from a wellbore and continuously separate slurry 16*a*-16*c* from the fluid 25 from the wellbore.

In embodiments, the slurry can be made up of cuttings discharge and an oil and water emulsion.

A usable means for separating particulate from drilling fluid can be a SCOMI PRIMA G™ 3 panel, 4 panel or 5 panel configuration shaker. Typically, a 6 G force to 9 G force shaker can be usable herein.

The means for separating particulate from drilling fluid 10*a* can produce slurry 16*a*, the means for separating particulate from drilling fluid 10*b* can produce slurry 16*b*, and the means for separating particulate from drilling fluid 10*c* can produce slurry 16*c*.

Each means for separating particulate from drilling fluid can be connected to a power supply 11*a*, which can be an on rig diesel generator or a ship's electrical system.

Additional treatment equipment described herein can be powered by a second power supply 11*b*.

In embodiments, additional solids control equipment can be used after the means for separating particulate from drilling fluid.

The additional solids control equipment installed after the means for separating particulate from drilling fluid can be desilters, desanders, mud cleaners, decanting centrifuges, cuttings driers, and combinations thereof. Typical cuttings driers can be perforated bowl centrifuges.

Slurries 16*a*, 16*b*, and 16*c* can flow into a cuttings discharge collection device 50.

In embodiments, the cuttings discharge collection device 50 can be a screw conveyor for continuously flowing the slurry away from the means for separating particulate from drilling fluid.

The cuttings discharge collection device 50 can be connected to the first power supply 11*a* if the cuttings discharge device is a moving device.

In embodiments, the cuttings discharge collection device 50 can be an auger which rotates.

In other embodiments, the cuttings discharge collection device can be a non-moving device that uses gravity to flow slurry from the means for separating particulate from drilling fluid.

Using a gravity device as the cuttings discharge collection device can require a configuration wherein the means for separating particulate from drilling fluid is at an elevation greater than the cuttings discharge collection device, allowing gravity to move the slurry away from the means for separating particulate from drilling fluid, as the slurry enters the gravity device, which can be a gravity ditch in embodiments.

In embodiments, the lack of moving parts is a feature of this invention. It improves the overall safety of the system.

A cuttings discharge collection device without moving parts also has no need for energy, reducing the carbon footprint of the overall invention.

The cuttings discharge collection device 50 can transfer the slurry 16*d* to surge storage 52. The surge storage can be a tank.

The rate at which slurry 16*d* enters the surge storage 52 can be controlled by a materials handling controller 45 in electronic communication with valves on the surge storage.

The surge storage, in embodiments, can have a 2 ton to 30 ton capacity. The surge storage can have any size that can fit in the space available on the offshore rig, such as on the rig deck. The surge storage can be vented in embodiments.

The materials handling controller 45 can communicate bidirectionally with the cuttings discharge collection device 50 and with the surge storage to monitor and control continuous movement of the slurry and continuous treatment of the slurry by the means for separating particulate from drilling fluid without creating overflows of material into the sea or spilling in another manner.

The material handling controller 45 can communicate simultaneously with a cuttings discharge collection device 50, a surge storage 52, a first pneumatic conveyor 56 and a first screw conveyor 58 in embodiments.

The material handling controller 45 can be powered by the power supply 11*a*.

The material handling controller 45 can also communicate with two buffer tanks 20*a* and 20*b*. Each buffer tank can have an inlet valve 21*a* and 21*b*, which can communicate electronically with the material handling controller 45, and an outlet valve 23*a* and 23*b*, which can communicate electronically with the treatment system controller 44.

The first screw conveyor 58 can be connected to the surge storage 52 for moving the slurry from the surge storage to a first pneumatic conveyor 56 according to preset volume limits for the surge storage stored in the material handling controller 45.

The material handling controller 45 can use computer instructions to activate the pneumatic conveyor 56 when the preset volume limits are approached as detected by a sensor 204 in the surge storage that communicates directly with the material handling controller.

The material handling controller can use computer instructions to activate the first screw conveyor 58 to additionally move slurry when the drilling rig is producing drilling cuttings and drill fluid at a rate higher than the pneumatic conveyor can operate.

The first screw conveyor 58, in embodiments, can be an Archimedes screw auger. In other embodiments, the screw conveyor can be a device that does not require a screw, such as a gravity fed conveying device, such as a gravity chute.

The first pneumatic conveyor 56 can be fluidly connected to the first screw conveyor for moving slurry from the surge storage at variable rates, such as from 1 ton an hour to 60 tons an hour, for example. The first pneumatic conveyor 56 can also be connected to the power supply 11*a*.

The material handling controller 45 can use computer instructions to change the rates of movement of the slurry from the surge storage using the first pneumatic conveyor for continuous fluid flow, without overflowing or allowing back up.

A usable pneumatic conveyor is the SCOMI CBP™ 800 pneumatic conveyor having no more than 120 psi, and which can be as low as 40 psi, for safe, low pressure operation on a drilling rig.

The treatment system controller 44 can be connected to the power supply 11*b*.

In addition to communicating with the material handling controller 45, the treatment system controller 44 can communicate bidirectionally with the buffer tanks 20*a* and 20*b*; a second screw conveyor 60; the continuous cuttings processing station 30; a second pneumatic conveyor 62 for conveying discharge to a transport vessel 64, such as a workboat; and a filling station 61.

Multiple screw conveyors can be used in the system sequentially or in parallel to increase capacity for treating the continuously flowing drilling fluid.

The buffer tanks 20*a* and 20*b* can be in fluid communication with the first pneumatic conveyor 56 for receiving slurry and providing buffer storage for the continuous drilling fluid treatment.

In embodiments, each buffer tank can hold from 20 tons to 30 tons.

In an embodiment, one buffer tank can have a volume of less than 20 tons by connecting to the first tank in series to prevent overflow of the material handling system of the invention.

The buffer tanks are shown connected in parallel, but other embodiments can have the buffer tanks connected in series. The buffer tanks can be steel tanks.

In embodiments, the buffer tanks can be sufficiently rigid, such that the entire buffer tank can be lifted by a crane without deforming while empty of slurry.

In embodiments, the valves and on each tank can be in communication with the treatment system controller 44 to regulate the continuous treatment of the fluid from the wellbore without overfilling the buffer tank or overfilling the second screw conveyor 60.

The valves can be an actuatable knife gate valves, butterfly valves or ball valves.

In an embodiment, the valves of the buffer tanks can be operated by the both the treatment system controller 44 and the material handling controller 45 using computer instructions in both controllers that compare the flow rates from the tanks to the flow rates of other equipment controlled by the respective controller, and then open or close valves to increase or decrease flow rates based on preset limits.

The second screw conveyor 60 can be electronically connected to the treatment system controller 44.

In embodiments, the second screw conveyor can be a 16 inch diameter auger that can rotate at a variable speed and is capable of moving slurry at rates from 1 ton an hour to 60 tons an hour.

The second screw conveyor 60 can be connected to the power supply 11*b*.

The second screw conveyor 60 can move fluid from the buffer tanks to a continuous cuttings processing station 30.

The continuous cuttings processing station 30 can be electronically connected to the treatment system controller 44 and can be in fluid communication with the second screw conveyor 60.

After treatment by the continuous cuttings processing station 30, the slurry can be processed into two different flows, a flow of water vapor with oil droplets and cleaned cuttings 38*a* and 38*b*.

The cleaned cuttings can be moved in two different directions as shown.

Cleaned cuttings 38*a* can be transferred to a second pneumatic conveyor 62 which can be controlled by the treatment system controller 44 for conveying the cleaned cuttings to a transport vessel 64, such as a truck, barge or rail car.

For example, a 1 ton to 30 ton an hour pneumatic discharge conveyor 62 can be used in the system.

In embodiments, the cleaned cuttings 38*b* can be transferred to a filling station 61.

The filling station 61 can be used for filling skips, such as 8 ton skips, with the cleaned cuttings in this continuous treatment process. The filling station can be located on the drilling rig.

In embodiments, the filling station 61 can be an auger with multiple discharge points for filling skips. The filling station can be an auger capable of moving cleaned cuttings at rates from 1 ton to 60 tons an hour.

The material handling controller 45 can communicate directly with the treatment system controller 44.

Figure 2:
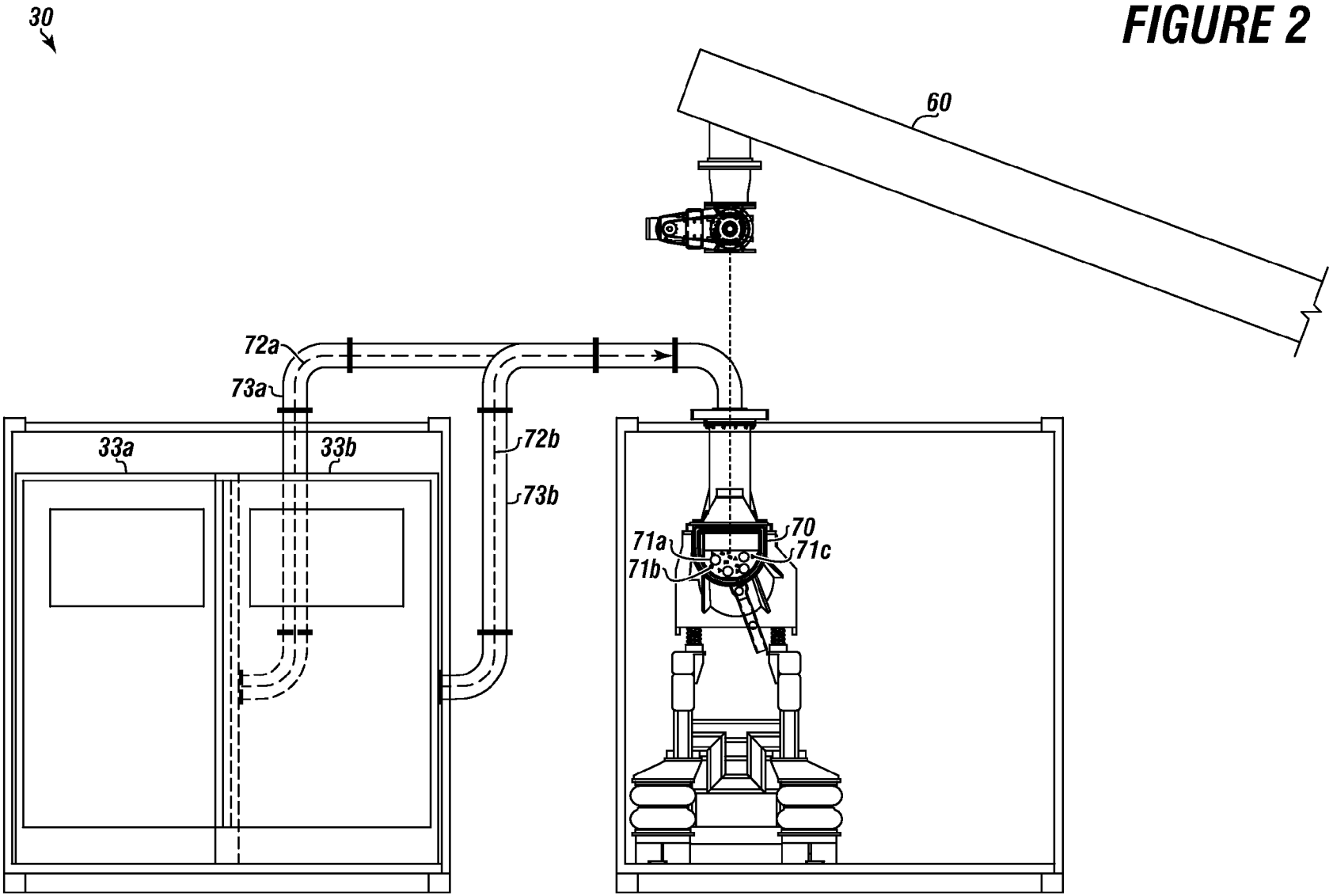
FIG. 2 depicts an embodiment of the continuous cuttings processing station.

FIG. 2 depicts an embodiment of the continuous cuttings processing station.

The continuous cuttings processing station 30 can have a vibrating trough 70 that can vibrate at from 2 G forces to 6 G forces. The G force can be created, in embodiments, by an eccentrically weighted shaft of the vibrating trough that is operated by a motor.

The vibrating trough 70 can be connected electronically to the treatment system controller and electrically to the power supply.

In embodiments, the vibrating trough 70 can have a shape that is elliptical, oval or linear, such as straight.

In the vibrating trough 70, a plurality of non-deforming microwave heatable polishing and grinding media 71*a*-71*c* can be disposed.

In embodiments, the non-deforming microwave heatable polishing and grinding media can have a shape that is circular, triangular, rectangular, oval, or another angular shape.

In embodiments, the vibrating trough can be filed with a quantity of non-deforming microwave heatable polishing and grinding media that fill from 10 percent to 50 percent by volume of the vibrating trough. In different embodiments, up to 20,000 non-deforming microwave heatable polishing and grinding media can be used in a 6 to 20 foot long vibrating trough depending on the diameter of the non-deforming microwave heatable polishing and grinding media.

In embodiments, it is important that the non-deforming microwave heatable polishing and grinding media are not large, having diameters from 0.25 inches to 0.5 inches each.

The continuous cuttings processing station 30 can have at least one microwave generator for heating the vibrating particulate in the vibrating trough. Two microwave generators 33*a* and 33*b* are shown. Each microwave generator can be electrically connected to the power supply and electronically connected to the treatment system controller.

The microwave generators 33*a* and 33*b* can produce microwaves 72*a* and 72*b* respectively. The microwaves can heat the oil and water emulsion in the slurry and the non-deforming microwave heatable polishing and grinding media simultaneously.

In embodiments, the microwave generators can generate from 75 kilowatts to 150 kilowatts of microwave energy.

A special feature of this invention relates to the use of the microwave generators.

In this invention, the microwave generators are used to preferentially heat water first, rather than heat the entire slurry. By preferentially heating the water first the microwaves create a steam that strips the oil from the cuttings and carries off the oil for recovery with the water vapor.

A major advantage of this invention is that the microwave generators use less energy for cleaning cuttings than any known device, by at least 15 percent.

In embodiments, the invention is anticipated to clean cuttings using 30 percent less energy, and upwards of 50 percent less energy than commercial devices that heat all of the slurry rather than preferentially heat the water in the slurry first along with heating the non-deforming microwave heatable polishing and grinding media.

In embodiments, each microwave generator can use a microwave waveguide 73*a* and 73*b*.

Each microwave waveguide can direct microwaves produced from each microwave generator to the vibrating trough for preferentially heating the water in the slurry and for heating the non-deforming microwave heatable polishing and grinding media in the vibrating trough.

The flow of slurry, which can include drill cuttings, can flow into the continuous cuttings processing station 30 from the second screw conveyor 60.

Figure 3:
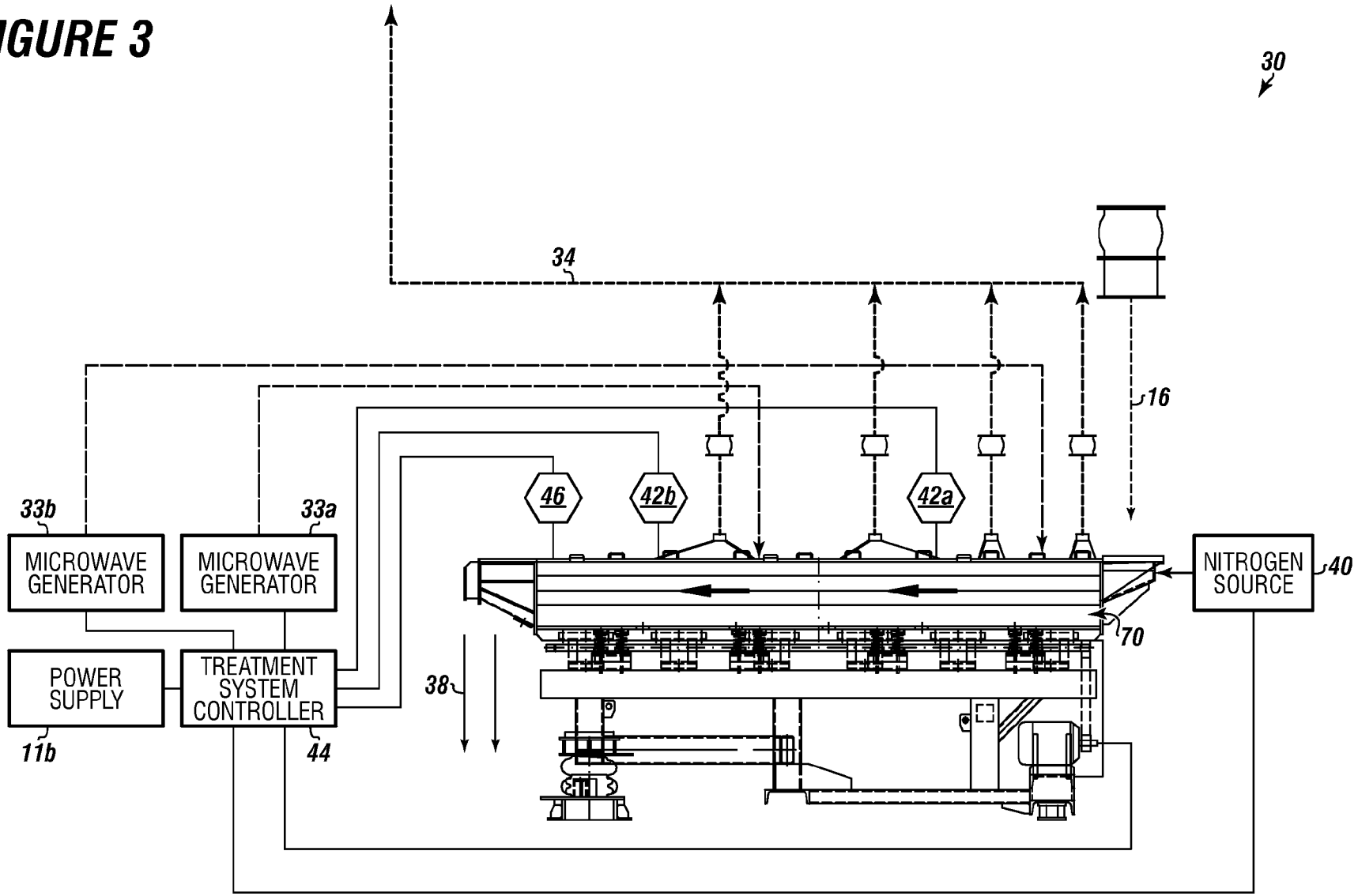
FIG. 3 depicts an embodiment of the continuous cuttings processing station with additional features.

FIG. 3 depicts an embodiment of the continuous cuttings processing station with additional features.

The continuous cuttings processing station 30, which can be controlled by the treatment system controller 44, can continuously create two streams of material (i) a water vapor with oil droplets 34 and (ii) cleaned cuttings 38.

In embodiments, the continuous microwave particulate treatment system can operate at a processing rate from 1 ton to 30 tons per hour.

The continuous cuttings processing station 30 for receiving slurry 16 can have at least one temperature probe 42*a* and 42*b* connected to the treatment system controller 44 for transmitting the temperature in the vibrating trough to the treatment system controller 44.

The continuous cuttings processing station 30 can have a differential pressure transducer 46 connected to the treatment system controller 44 for transmitting the pressure inside the vibrating trough to the treatment system controller 44.

The treatment system controller 44 can be connected to the power supply 11*b* and can be in electronic communication with the microwave generators 33*a* and 33*b*.

The continuous cuttings processing station 30 can have a vibrating trough 70 into which nitrogen can be blown from a nitrogen source 40. The nitrogen source can be used to control oxygen levels in the vibrating trough 70 in embodiments. The trough can be a linear vibrating trough in embodiments.

The nitrogen source can also be connected to the treatment system controller 44 for regulating the amount and duration of each introduction of nitrogen using computer instructions in the treatment system controller.

Figure 4:
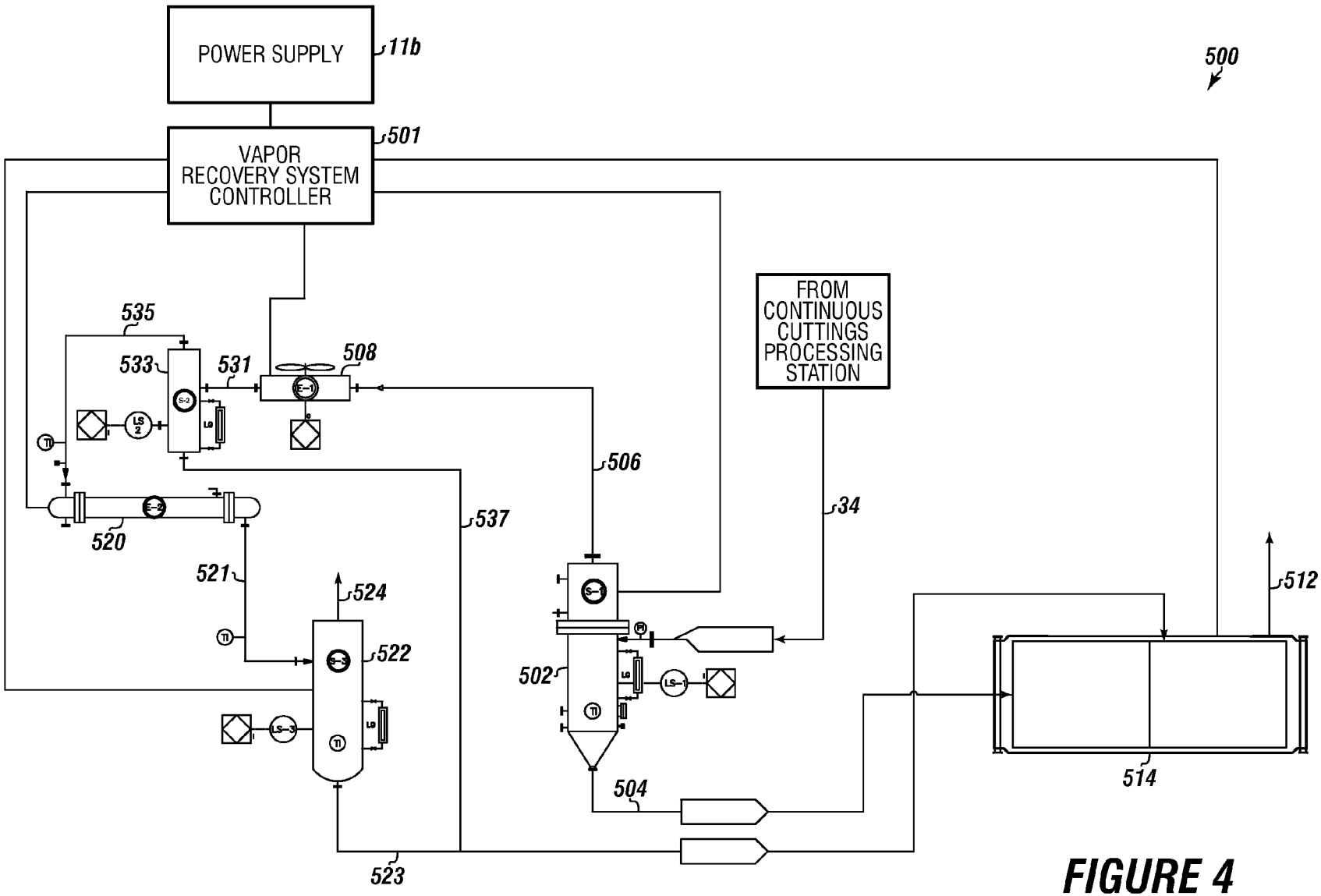
FIG. 4 depicts a vapor recovery system according to one or more embodiments.

FIG. 4 depicts a vapor recovery system for receiving the water vapor with oil droplets 34 from the continuous cuttings processing station.

The vapor recovery system 500 can have a vapor recovery system controller 501 for communicating with the material handling controller and the treatment system controller for regulating the continuous operation of the entire system.

The vapor recovery system 500 can flow the water vapor with oil droplets 34 to a scrubber 502 for cooling the water vapor with oil droplets 34 and condensing the oil into an oil stream 504, and for simultaneously forming a heated vapor stream 506.

The vapor recovery system 500 can have a fin fan heat exchanger 508 for cooling the heated vapor stream 506 to a lower temperature forming a heated vapor and cooled liquid stream 531.

The heated vapor and cooled liquid stream 531 can be transferred from the fin fan heat exchanger 508 to a separation tank 533.

The separation tank 533 can allow first cooled liquid stream 537 to drop out for removal to an oil and water separator 514. The separation tank 533 can also create a stream of remaining heated vapor 535 which can then be transferred to a cooling unit 520.

The cooling unit 520 can receive the remaining heated vapor 535 from the separation tank 533 and form a condensed vapor 521.

A condensation tank 522 can receive the condensed vapor 521 and form a second cooled liquid stream 523. The second cooled liquid stream 523 can be mixed with the first cooled liquid stream 537 and then transferred to the oil and water separator 514.

The oil and water separator 514 can receive the oil stream 504 from the scrubber 502 and the cooled liquid stream from the separation tank and the condensation tank.

The oil and water separator 514 can produce recovered oil 512 from these inflows and transfer the recovered oil 512 to a tank.

Water formed in the vapor recovery process can be further treated and then returned to the sea, transferred back into the drilling fluid, or removed from the drilling rig.

The condensation tank 522 can be used for separating residual vapor 524 from condensed vapor 521 forming a second cooled liquid stream 523. Also, the condensation tank can be in communication with the vapor recovery system controller 501.

The vapor recovery system controller 501 can also be connected to the scrubber 502, fin fan heat exchanger 508, oil and water separator 514, and cooling unit 520.

The vapor recovery system controller 501, scrubber 502, fin fan heat exchanger 508, oil and water separator 514, and cooling unit 520 can all be connected to the power supply 11*b*.

Figure 5A:
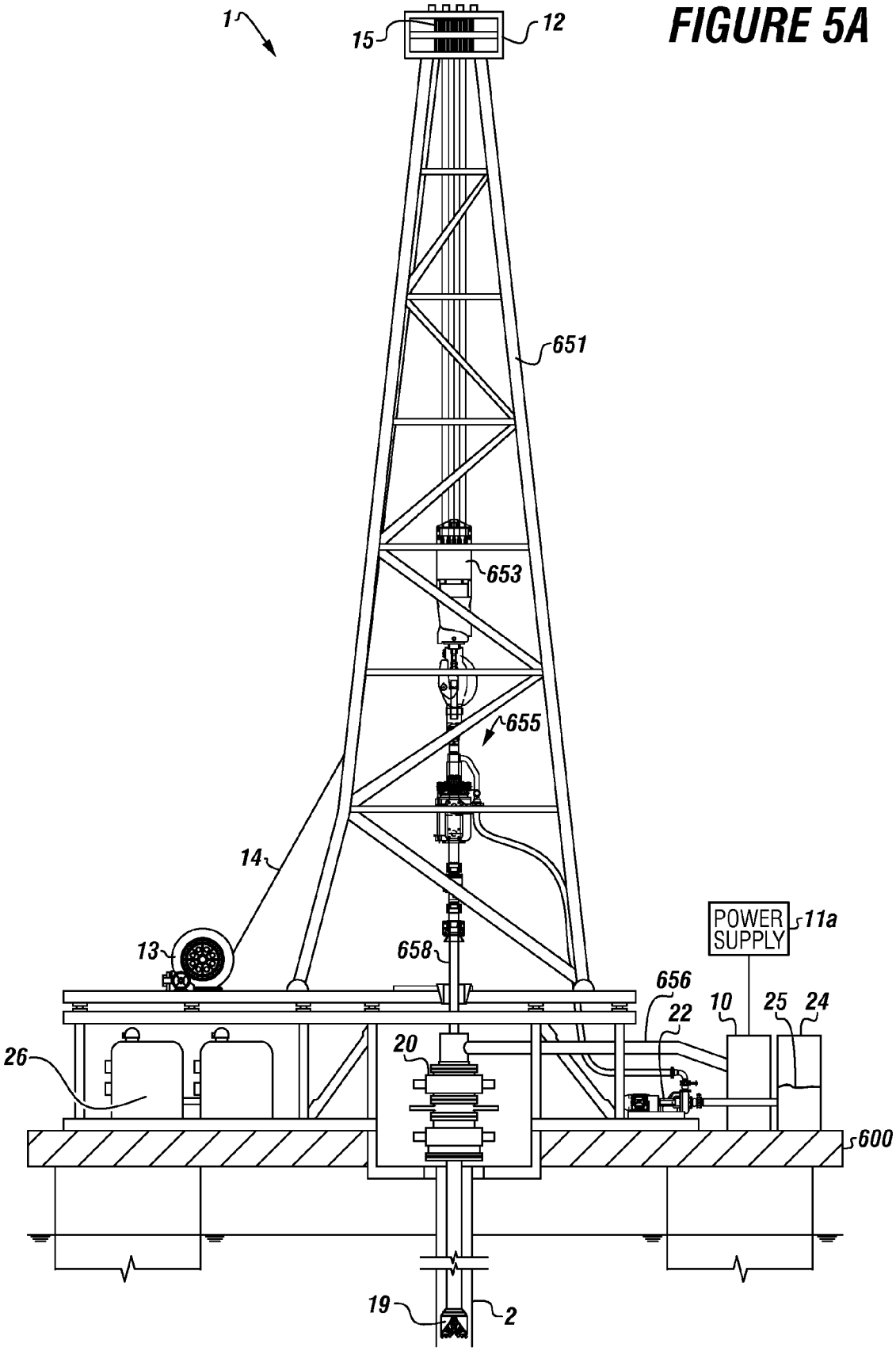
FIG. 5A depicts an embodiment of the system on a floating vessel with a drilling rig.

FIG. 5A depicts a drilling rig with the continuous microwave particulate drilling system on a floating vessel.

The drilling rig 1 can have a derrick 651, a hoist 13 with a wireline 14 connected to a crown 12 through sheaves 15 to a travelling block 653 holding drill pipe 658 turned into a wellbore 2, and mud pumps 22 for pumping drilling fluid 25 from a tank 24 down the wellbore.

A turning means 655 can be connected to the travelling block 653 for grabbing at least one tubular 658 and turning the tubular into a wellbore 2.

Engines 26 can drive the hoist and the mud pumps.

The drill pipe can have a drill bit 19 connected thereto.

The drilling fluid can come back out of the wellbore through a conduit 656 from a blowout preventer 20 to a means for separating particulate from drilling fluid 10 and then to the treatment and materials handling equipment of the system.

A power supply 11*a* can be connected to the motorized equipment.

Figure 5B:
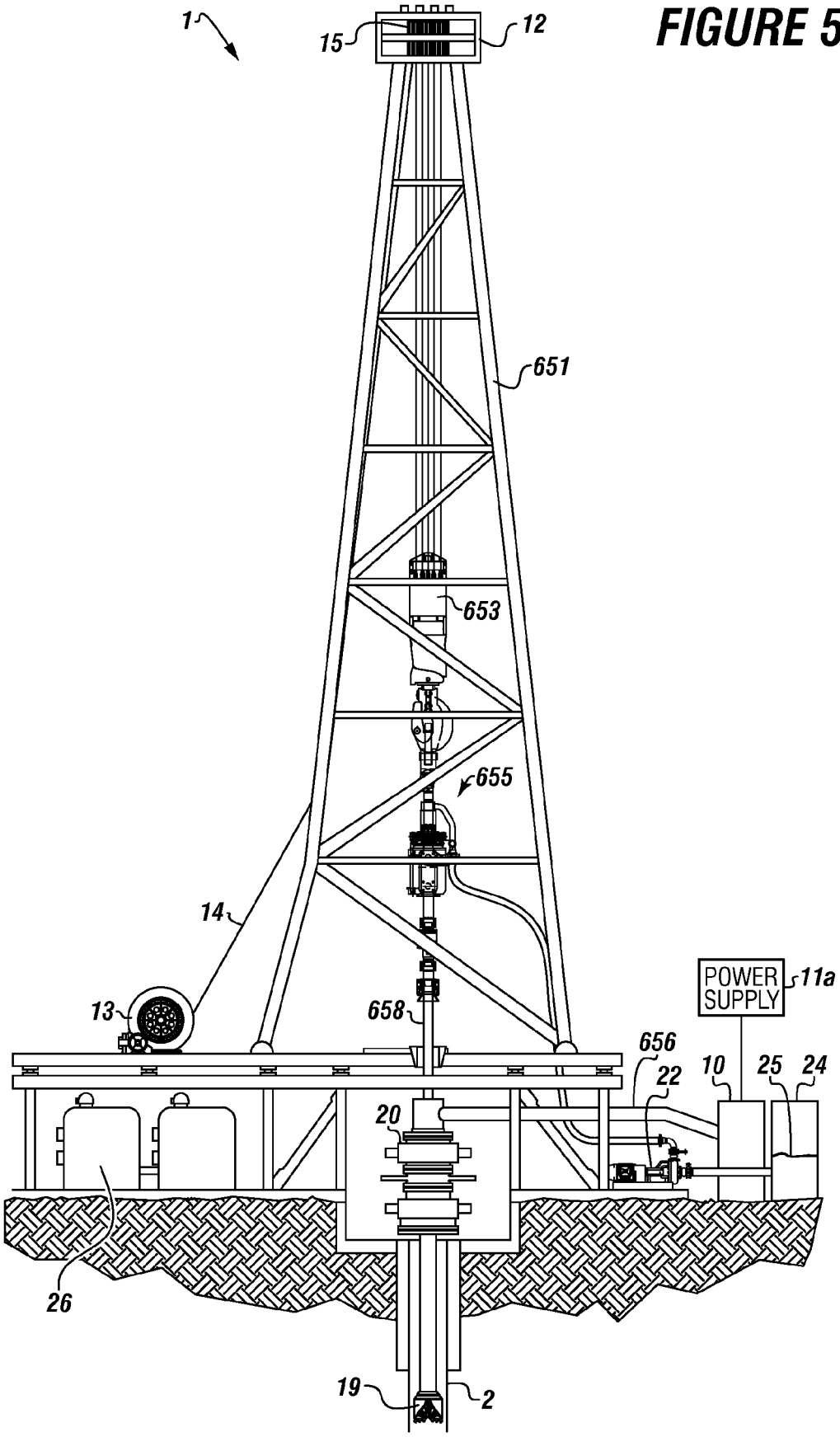
FIG. 5B depicts a drilling rig with the continuous microwave particulate drilling system on land.

FIG. 5B depicts a drilling rig with the continuous microwave particulate drilling system on land.

The drilling rig 1 can have a derrick 651, a hoist 13 with a wireline 14 connected to a crown 12 through sheaves 15 to a travelling block 653 holding drill pipe 658 turned into a wellbore 2, and a mud pumps 22 for pumping drilling fluid 25 from a tank 24 down the wellbore.

A turning means 655 can be connected to the travelling block 653 for grabbing at least one tubular 658 and turning the tubular into a wellbore 2.

Engines 26 can drive the hoist and the mud pumps.

The drill pipe can have a drill bit 19 connected thereto.

The drilling fluid can come back out of the wellbore through a conduit 656 from a blowout preventer 20 to a means for separating particulate from drilling fluid 10 and then to the treatment and materials handling equipment of the system.

A power supply 11*a* can be connected to the motorized equipment.

Figure 6A:
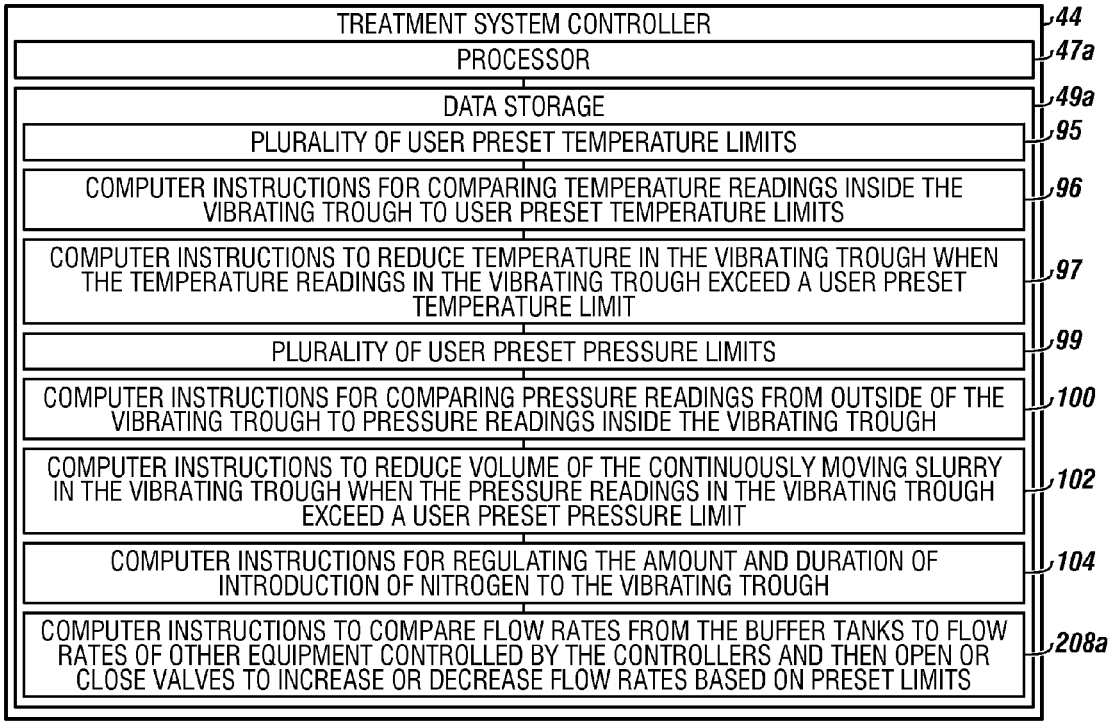
FIG. 6A depicts a diagram of the treatment system controller according to one or more embodiments.

FIG. 6A depicts a diagram of the treatment system controller.

The treatment system controller 44 can have a processor 47*a* connected to a data storage 49*a*.

The data storage 49*a* can include a plurality of user preset temperature limits 95, such as 200 degrees Celsius or 125 degrees Celsius indicating a maximum temperature for heating the water in the slurry and for heating the non-deforming microwave heatable polishing and grinding media in the trough.

The data storage 49*a* can include computer instructions 96 for comparing temperature readings inside the vibrating trough to user preset temperature limits, and computer instructions 97 to reduce temperature in the vibrating trough when the temperature readings in the vibrating trough exceed a user preset temperature limit.

The data storage 49*a* can include a plurality of user preset pressure limits 99, such as 5 inches to 20 inches of water+/−a small amount of negative or positive pressure, from 0.1 psi to 5 psi.

The data storage 49*a* can include computer instructions 100 for comparing pressure readings from outside of the vibrating trough to pressure readings inside the vibrating trough, and computer instructions 102 to reduce the volume of the continuous moving slurry in the vibrating trough when the pressure readings in the vibrating trough exceed a user preset pressure limit.

The data storage 49*a* can include computer instructions 104 for regulating the amount and duration of introduction of nitrogen to the vibrating trough.

The data storage 49*a* can include computer instructions 208*a* to compare flow rates from the buffer tanks to flow rates of other equipment controlled by the controllers and then open or close valves to increase or decrease flow rates based on preset limits.

Figure 6B:
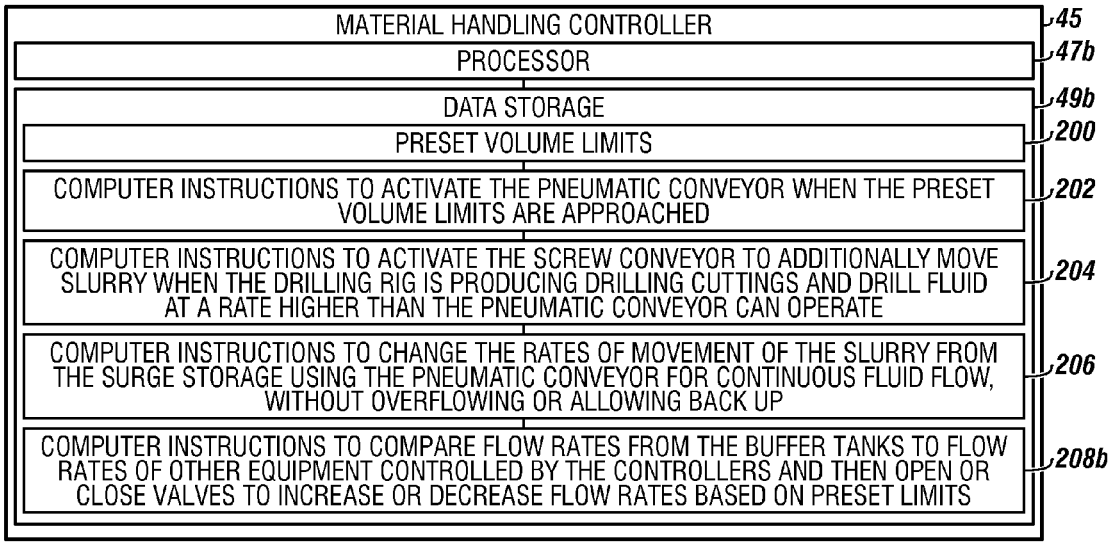
FIG. 6B depicts a diagram of the material handling controller according to one or more embodiments.

FIG. 6B depicts a diagram of the material handling controller.

The material handling controller 45 can have a processor 47*b* connected to a data storage 49*b*.

The data storage 49*b* can include preset volume limits 200 for the surge storage.

The data storage 49*b* can include computer instructions 202 to activate the pneumatic conveyor when the preset volume limits are approached, which can be detected by a sensor in the surge storage that communicates directly with the material handling controller.

The data storage 49*b* can include computer instructions 204 to activate the screw conveyor to additionally move slurry when the drilling rig is producing drilling cuttings and drill fluid at a rate higher than the pneumatic conveyor can operate.

The data storage 49*b* can include computer instructions 206 to change the rates of movement of the slurry from the surge storage using the pneumatic conveyor for continuous fluid flow, without overflowing or allowing back up.

The data storage 49*b* can include computer instructions 208*b* to compare flow rates from the buffer tanks to flow rates of other equipment controlled by the controllers and then open or close valves to increase or decrease flow rates based on preset limits.

In embodiments, a vapor recovery system controller for communicating with the material handling controller and the treatment system controller for regulating the continuous operation of the entire invention can be a computer with communication links to the other controllers and computer instructions to allow continuous operation of the vapor recovery system by regulating vapor flow through the various pieces of equipment automatically using user preset guidelines.

In embodiments, any of the controllers can be computers.

In embodiments of the system, the cleaned cuttings with water can be discharged into a tank or into a debris area overboard of the floating vessel.

In embodiments, the continuous cuttings processing station can have a separation device between the angle of incidence of the microwaves and vibrating particulates in the trough which are heated by not only the microwaves but also by the non-deforming microwave heatable polishing and grinding media heated by the microwaves simultaneously.

The dual heating of the particulates and the non-deforming microwave heatable polishing and grinding media while vibrating the particulates and slurry enables the fast energy efficient separation of the particulate form the water vapor with oil droplets and the cleaned cuttings.

While these embodiments have been described with emphasis on the embodiments, it should be understood that within the scope of the appended claims, the embodiments might be practiced other than as specifically described herein.

What is claimed is:

1. A continuous microwave particulate treatment system for treating fluid from a wellbore, the continuous microwave particulate treatment system comprising:

a. at least one means for separating particulate from drilling fluid connected to a power supply, wherein the at least one means for separating particulate from drilling fluid receives drilling fluid from the wellbore and separates the fluid into a slurry, wherein the slurry comprises cuttings discharge and an oil and water emulsion;

b. a cuttings discharge collection device connected to the power supply, and connected to each means for separating particulate from drilling fluid for continuously moving slurry from each means for separating particulate from drilling fluid;

c. a material handling controller connected electrically to the power supply and electronically connected to each of the means for separating particulate from drilling fluid and the cuttings discharge collection device, wherein the material handling controller regulates flow of the drilling fluid into each means for separating particulate from drilling fluid and regulating flow of the slurry from each means for separating particulate from drilling fluid, and through the cuttings discharge collection device; and d. a continuous cuttings processing station electronically connected to the treatment system controller and in fluid communication with the cuttings discharge collection device, the continuous cuttings processing station comprising:

(i) a vibrating trough for continuously receiving the slurry from the cuttings discharge collection device;

(ii) a plurality of non-deforming microwave heatable polishing and grinding media disposed in the vibrating trough;

(iii) at least one microwave generator for continuously irradiating the slurry in the vibrating trough with microwaves, wherein the microwaves heat water in the slurry while simultaneously heating the plurality of non-deforming microwave heatable polishing and grinding media disposed in the vibrating trough; and (iv) at least one microwave waveguide directing microwaves from each microwave generator at the slurry in the vibrating trough;

wherein the continuous cuttings processing station treats slurry continuously, creating water vapor and oil droplets and cleaned cuttings; and wherein the material handling controller and treatment system controller communicate with each other using computer instructions to compare flow rates to preset limits to ensure continuous cleaning of the drilling fluid without overflow.

2. The continuous microwave particulate treatment system of claim 1, wherein the cleaned cuttings are discharged into a tank or overboard.

3. The continuous microwave particulate treatment system of claim 1, further comprising a nitrogen source connected to the continuous cuttings processing station to blow nitrogen into the vibrating trough to control oxygen levels in the vibrating trough, wherein the nitrogen source is connected to the treatment system controller and the power supply.

4. The continuous microwave particulate treatment system of claim 1, further comprising:

a. at least one temperature probe connected to the treatment system controller disposed in the continuous cuttings processing station;

b. a plurality of user preset temperature limits in the treatment system controller;

c. computer instructions in the treatment systems controller for comparing temperature readings inside the vibrating trough to the user preset temperature limits; and d. computer instructions in the treatment system controller to reduce temperature in the vibrating trough when the temperature readings in the vibrating trough exceed the user preset temperature limits.

5. The continuous microwave particulate treatment system of claim 1, further comprising:

a. at least one differential pressure transducer for providing pressure readings of pressure inside of the vibrating trough and pressure readings outside the vibrating trough;

b. a plurality of user preset pressure limits in the treatment system controller;

c. computer instructions in the treatment system controller for comparing pressure readings to the user preset pressure limits; and d. computer instructions in the treatment system controller to reduce volume of the continuously moving slurry in the vibrating trough when the pressure readings in the vibrating trough exceed a user preset pressure limit.

6. The continuous microwave particulate treatment system of claim 1, wherein the continuous cuttings processing station processes slurry at rates from 1 ton to 30 tons per hour.

7. The continuous microwave particulate treatment system of claim 1, further comprising a filling station for receiving cleaned cuttings from the continuous cuttings processing station.

8. The continuous microwave particulate treatment system of claim 1, further comprising a second pneumatic conveyor for moving the cleaned cuttings from the continuous cuttings processing station to a transport vessel for discharge.

9. The continuous microwave particulate treatment system of claim 1, wherein the plurality of non-deforming microwave heatable polishing and grinding media each have a shape that is circular, triangular, rectangular, oval, or another angular shape.

10. The continuous microwave particulate treatment system of claim 1, wherein the quantity of non-deforming microwave heatable polishing and grinding media in the vibrating trough fills from 10 percent to 50 percent by volume of the vibrating trough.

11. The continuous microwave particulate treatment system of claim 1, wherein the vibrating trough has a shape that is elliptical, oval or linear.

12. The continuous microwave particulate treatment system of claim 1, comprising a vapor recovery system for receiving the water vapor with oil droplets.

13. The continuous microwave particulate treatment system of claim 12, wherein the vapor recovery system comprises:

a. a vapor recovery system controller connected to the materials handling controller and the treatment systems controller;

b. a scrubber for cooling the water vapor with oil droplets from the cuttings processing station and condensing oil into an oil stream and wherein the scrubber also forms a separated heated vapor stream, and wherein the scrubber is in communication with the vapor recovery system controller;

c. a fin fan heat exchanger for cooling the separated heated vapor stream forming a heated vapor and cooled liquid stream, and wherein the fin fan heat exchanger is in communication with the vapor recovery system controller;

d. a separation tank for receiving the heated vapor and cooled liquid stream allowing a first cooled liquid stream to drop out, wherein the separation tank also forms a stream of remaining heated vapor;

e. a cooling unit for receiving the remaining heated vapor forming condensed vapor, wherein the cooling unit is in communication with the vapor recovery system controller;

f. a condensation tank for separating residual vapor from condensed vapor forming a second cooled liquid stream; wherein the condensation tank is in communication with the vapor recovery system controller; and g. an oil and water separator for receiving an oil stream, the second cooled liquid stream and the first cooled liquid stream and forming recovered oil, wherein the oil and water separator is in communication with the vapor recovery system controller.

14. The continuous microwave particulate treatment system of claim 1, comprising a surge storage fluidly connected to the cuttings discharge collection device for receiving the slurry and electronically connected to the material handling controller and connected electrically to the power supply, wherein the material handling controller regulates flow of the slurry into the surge storage from a first pneumatic conveyor.

15. The continuous microwave particulate treatment system of claim 14, wherein the first pneumatic conveyor electronically connected to the material handling controller and fluidly connected to the means for separating particulate from drilling fluid, wherein the first pneumatic conveyor moves slurry from the means for separating particulate from drilling fluid, and wherein the first pneumatic conveyor is connected to the power supply.

16. The continuous microwave particulate treatment system of claim 15, further comprising: a screw conveyor connected to the surge storage for moving the slurry to the surge storage when the drilling rig is producing at a rate higher than the first pneumatic conveyor can operate.

17. The continuous microwave particulate treatment system of claim 16, comprising at least one buffer tank in communication with the material handling controller, wherein each buffer tank has an inlet valve in electronic communication with the material handling controller, wherein each buffer tank is in fluid communication with the first pneumatic conveyor, wherein each buffer tanks has an outlet valve in electronic communication with a treatment system controller, and wherein each buffer tank is configured for receiving slurry.

18. The continuous microwave particulate treatment system of claim 17, comprising a second screw conveyor electronically connected to the treatment system controller and fluidly connected to the buffer tanks for continuously moving slurry from each buffer tank.

* * * * *